US005812054A

United States Patent [19]

Cohen

[11] Patent Number: 5,812,054

[45] Date of Patent: Sep. 22, 1998

[54] DEVICE FOR THE VERIFICATION OF AN ALARM

[75] Inventor: Moshe Cohen, Tel-Aviv, Israel

[73] Assignee: Audiogard International Ltd., Tel Aviv, Israel

[21] Appl. No.: 435,722

[22] Filed: May 5, 1995

[30] Foreign Application Priority Data

May 9, 1994 [IL] Israel ..... 109601

[51] Int. Cl.[6] ..... G08B 29/00

[52] U.S. Cl. ..... 340/506; 340/531; 340/539; 340/825.24; 379/38; 379/39; 348/143

[58] Field of Search ..... 379/38, 39, 41, 379/44, 45; 340/531, 539, 825.24, 825.25; 348/143, 152

[56] References Cited

U.S. PATENT DOCUMENTS

| | | | |
|---|---|---|---|
| 4,060,803 | 11/1977 | Ashworth, Jr. | 340/539 |
| 4,652,859 | 3/1987 | Van Wienen | 340/503 |
| 5,335,264 | 8/1994 | Namekawa | 340/539 |
| 5,382,943 | 1/1995 | Tanaka | 340/539 |

FOREIGN PATENT DOCUMENTS

| | | |
|---|---|---|
| 0210889 | 2/1987 | European Pat. Off. . |
| 0236170 | 9/1987 | European Pat. Off. . |
| 2586451 | 2/1987 | France . |
| 02155100 | 6/1990 | Japan . |

OTHER PUBLICATIONS

European Search Report re: EP 95 10 6860, dated Jul. 27, 1995.

*Primary Examiner*—Thomas Mullen
*Assistant Examiner*—Daryl C. Pope
*Attorney, Agent, or Firm*—Michael D. Bednarek; Kilpatrick Stockton LLP

[57] ABSTRACT

The present invention relates to a device to be connected to any standard alarm control panel for the verification of the actuated alarm. This device includes one or two printed circuit board(s), preferably one, which is located within a house or integrated within the alarm control panel. On this board, which is referred to as an "Interface Module", are located an alarm panel interface for receiving the alarm signal from the alarm control panel, a specially programmed microcontroller, a non-volatile memory, an audio selecting matrix connected to at least one remote microphone unit, and a public switch telephone network (PSTN) interface, which is connected to a telephone line, through which the Interface Module communicates with the control station. The device may comprise many additional pieces of equipment, such as an audio storage unit; an integrated plug-in picture transmitter; a modem; a voltage free tamper output; an auxiliary voltage free nc/no relay(s) output; "power-on", "on-line", "failure" and "alarm" indicators; and an external unit enabling the testing and setting of the audio level of the inputs of the audio channel(s) and of any other parameters.

17 Claims, 8 Drawing Sheets

DEVICE FOR THE VERIFICATION OF AN ALARM

FIELD OF THE INVENTION

The present invention generally relates to the field of actuated alarms, and more particularly, to the remote verification of a triggered alarm and communication between the alarm reception point and the locations of the alarm triggers for a conventional alarm system.

BACKGROUND OF THE INVENTION

In commercially available guarding devices, when a burglar tries to break in a protected premise, the burglar actuates an alarm signal on the alarm control panel. This alarm may be actuated by other means (e.g., a "panic button"). The signal is sent to a central station (hereinafter called CS), such as a police station or a post of a guarding station. However, this is not always sufficient in view of the high rate of false alarms. Thus very often one or more additional operations are optionally required, which are not met by the current art, as such:

a. audio verification of the alarm;

b. acoustic detection of the alarm;

c. a "stored audio" feature enabling the CS operator to listen-in, for a predetermined period of time, to the recording of the sounds prior to the alarm activation in addition to the real-time audio (option a);

d. a two-way speech (i.e., enabling talking between the CS operator and the person(s) being in the protected premise); and e. video verification of the alarm.

There is known a device which can be used for some of the above possibilities. However, the existing device cannot be connected to any of the standard alarm control panels, but requires a special one.

It has thus been desirable to design a device which can be connected to any standard alarm control panel and, if desired, to be adapted to all the possibilities.

SUMMARY OF THE INVENTION

To achieve the stated and other objects of the present invention, as embodied and described below, the invention includes a device to be connected to any standard alarm control panel for the verification of the actuated alarm. The device includes at least one printed circuit board which is located within a housing or integrated within the alarm control panel. On the board are located an alarm panel interface receiving the alarm signal from the alarm control panel, a specially programmed microcontroller, a non-volatile memory, an audio selecting matrix being connected to at least one remote microphone unit and a PSTN interface connected to a telephone line, through which the Interface Module communicates with the control station. The device also includes an integrated plug-in picture transmitter module; the module includes a video transmitter and an integral cameras interface, the video transmitter being connected to a video transmitter interface being part of the Interface Module, wherein an external remote camera interface is integrated in the remote camera units, and comprises picture storage means.

The central station may comprise, inter alia, a PSTN line interface; listening equipment; remote control facilities; picture receivers; and talking back facilities.

The present invention relates to a device that enables the audio verification and other possibilities of verification and detection of an alarm caused by a burglar attacking a protected premise, or by other means (e.g., a "panic button") in a robbery.

It is readily understood that not all the above possibilities are always required. However, in connection with the present invention, the device should at least have the possibility of alarm verification.

To achieve the stated and other objects of the present invention, as embodied and described below, the invention includes a device to be connected to any standard alarm control panel for the verification of an actuated alarm. The device includes at least one printed circuit board that is located within a housing or integrated within the alarm control panel. On the board are located an alarm panel interface receiving the alarm signal from the alarm control panel, a specially programmed microcontroller, a non-volatile memory, an audio selecting matrix connected to at least one remote microphone unit, and a public switch telephone network (PSTN) interface that is connected to a telephone line. Through the telephone line, the Interface Module communicates with the control station via a modem on the board.

DETAILED DESCRIPTION

The present invention relates to a device to be connected to any standard alarm control panel for the verification of the actuated alarm. This device includes one or two printed circuit board(s), preferably one, which is located within a house or integrated within the alarm control panel. On this board, which is referred to as an "Interface Module", are located an alarm panel interface for receiving the alarm signal from the alarm control panel, a specially programmed microcontroller, a non-volatile memory, an audio selecting matrix connected to at least one remote microphone unit, and a public switch telephone network (PSTN) interface, which is connected to a telephone line, through which the Interface Module communicates with the control station. The device may comprise many additional pieces of equipment, such as an audio storage unit; an integrated plug-in picture transmitter; a modem; a voltage free tamper output; an auxiliary voltage free nc/no relay(s) output; "power-on", "on-line", "failure" and "alarm" indicators; and an external unit enabling the testing and setting of the audio level of the inputs of the audio channel(s) and of any other parameters.

The central station may comprise, inter alia, a PSTN line interface; listening equipment; remote control facilities; picture receivers; and talking back facilities.

The present invention relates to a device which enables the audio verification and other possibilities of verification and detection of an alarm caused by a burglar attacking a protected premise, or by other means (e.g. a "panic button") in a robbery.

It is readily understood that not all the above possibilities are always required. However, in connection with the present invention, the device should at least have the possibility of alarm verification.

There is known a device which can be used for some of the above possibilities. However, said device cannot be connected to any of the standard alarm control panels, but requires a special one.

It has thus been desirable to design a device which can be connected to any standard alarm control panel and, if desired, to be adapted to all the possibilities.

References will now be made in detail to an embodiment of the invention, an example of which is illustrated in the accompanying drawings, without being restricted by same.

Figure 1:
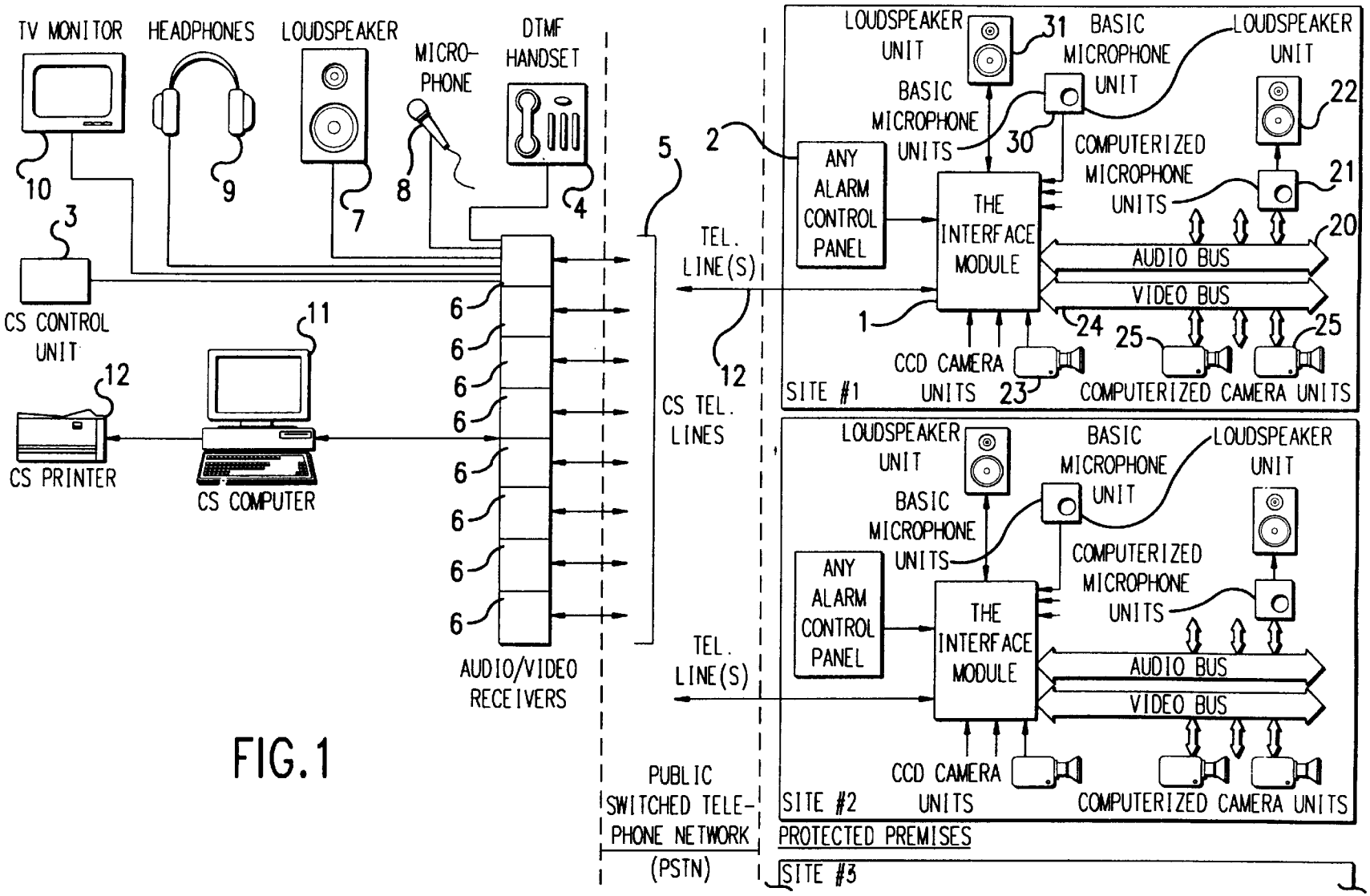
FIG. 1 shows a schematic block diagram of the arrangement of CS, alarm control panel and Interface Module in the protected premises, including optional equipment.

The diagram illustrated in FIG. 1 shows as general illustration of the verification system, all the options thereof and its integration with a commercially available alarm system. FIG. 1 presents a schematic block diagram of the arrangement of CS, alarm control panel, and Interface Module in the protected premises, including optional equipment. An embodiment of the present invention includes a device (hereinafter called "Interface Module") 1 (see FIG. 2 for more details) connected to any standard alarm control panel 2 for the verification of the actuated alarm, said device being one or two printed circuit board(s), preferably one, which is located within a housing or integrated within the alarm control panel.

As shown in FIG. 1, the Interface Module according to an embodiment of the present invention is controlled from any commercially available CS 3 for the verification of the alarm, provided the CS 3 comprises special equipment. In an embodiment of the present invention the equipment includes a handset 4 connected to the incoming telephone lines 5 and thus useable for audio verification purposes and for two-way speech communication. An embodiment of the present invention also includes special receiver units (hereinafter called "audio/video receivers") 6. In an embodiment of the present invention, the audio/video receiver 6 is contained within the Interface Module, but is controlled by other software and parameters. In an embodiment of the present invention, the audio/video receivers 6 are controlled by other CS control equipment, such as a desk-top control unit 3, including a DTMF keypad (not shown), an external loudspeaker 7, an internal or external microphone 8, headphones 9, a television monitor 10, and several control switches (not shown).

As is also shown in FIG. 1, in an embodiment of the present invention, the audio/video receivers 6 in the CS can be controlled by other means, such as a dedicated PC or the CS main computer 11, which may be connected to a printer 12. The basic audio/video receivers 6 are detailed below, with respect to FIG. 3.

The Interface Module(s) 1 according to the present invention are fully controllable from the CS 3, enabling downloading and changing their parameters and also updating the complete software.

In an embodiment of the present invention, the control of the Interface Module(s) 1 according to the present invention by the CS equipment is based upon dual tone multiple frequency (DTMF) signals, enabling control by the CS using a touch-tone keypad. As noted above, however, the control may also be achieved by a computer control, such as a dedicated PC or the CS computer 11.

The Interface Module 1 may transmit the verification signals to the CS via the PSTN lines used for the alarm panel communication or it may dial to a group of PSTN lines 12 dedicated for audio verification. Another option is dialing in from the CS to the Interface Modules 1 in the protected premises.

Other features connected to the Interface Module 1, as shown in FIG. 1, include an audio bus 20, a computerized microphone unit 21 connected to the audio bus 20, a speaker unit 22 connected to the computerized microphone unit 21, a camera unit 23, a video bus 24, computerized camera 25 units connected to the video bus 24, a basic microphone unit/loudspeakers units 30, and a loudspeaker unit 31.

Thus, as shown in FIG. 1, the additional CS equipment for verification, which is also part of an embodiment of the present invention may comprise:

a. PSTN line interface for holding the line, answering an incoming call or dialing out; this interface may be, for example, a DTMF handset 4; in most cases the PSTN line interface will be audio/video receiver(s) 6, which may share the line with the alarm receiver or have their own line;

b. listening-in equipment (e.g., a handset 4, an audio amplifier with loudspeaker 7 and/or headphones 9);

c. remote control facilities (e.g., a DTMF keypad or a computer 11);

d. picture receivers and TV monitors (optional) 10; and e. talking back facilities (optional) (e.g., a handset 4 or a microphone 8).

Figure 2:
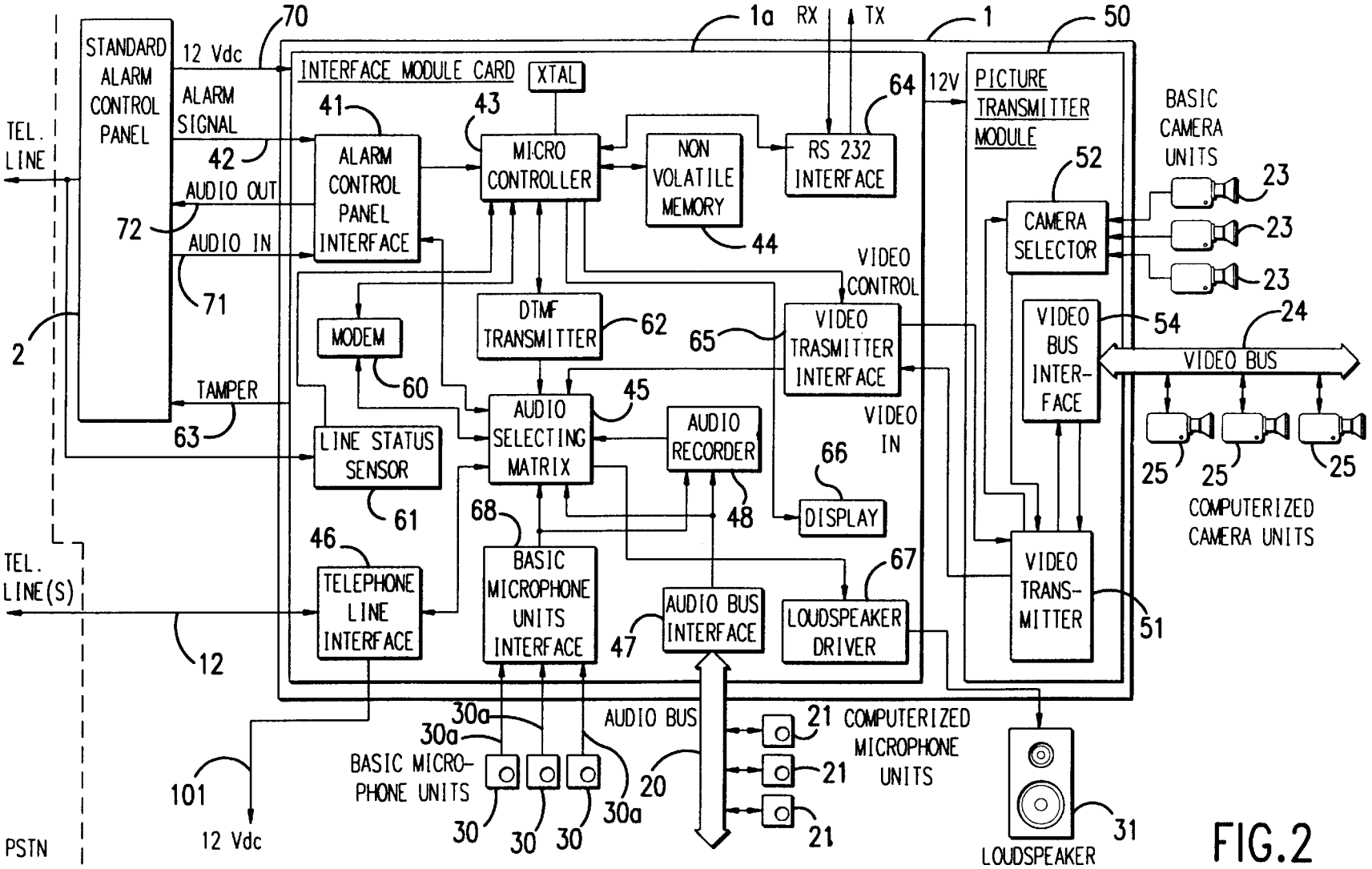
FIG. 2 shows a schematic block diagram of Interface Module with optional equipment.

FIG. 2 shows a schematic block diagram of Interface Module 1 with optional equipment for an embodiment of the present invention. As shown in FIG. 2, located on the printed circuit board (Interface Module Card) 1*a* of the Interface Module 1 are an alarm panel interface 41 receiving the alarm signal 42 from the alarm control panel 2, a specially programmed microcontroller 43, a non volatile memory 44, an audio selecting matrix 45 connected to at least one remote microphone unit 30, and a public switch telephone network (PSTN) interface 46, which is connected to a telephone line 12 through which the Interface Module 1 communicates with the CS (not shown; see FIG. 1).

As shown in FIG. 2, in an embodiment of the present invention, the Interface Module 1 is used not only for the verification of the alarm, but also for the detection thereof. In this embodiment, the remote microphone units 21 are a computerized type of microphone unit and are connected via an audio bus 20 and an audio bus interface 47 to an audio selecting matrix 45. An audio bus 20 refers to, in connection with the present invention, multiple remote microphone units 21 mounted on a single cable connected to the Interface Module 1. Via the audio bus 20, each remote microphone unit communicates individually with the Interface Module 1. Alternatively, as shown in FIG. 2, the microphone units 30 may be mounted on more than one cable (i.e., the bus means may extend parallel to each other 30*a*).

As shown in FIG. 2, when the recording of the alarm for a predetermined period of time is required, an audio storage unit, comprising an audio recorder 48 connected to the audio selecting matrix 45, is included as part of the Interface Module 1 according to an embodiment of the present invention.

The audio storage unit records the audio for said predetermined period of time (e.g., 32 seconds) before the alarm activation (if the delay is 0) or a few seconds before the alarm and a few seconds afterwards. The division of times before or after the alarm is selectable by a preset delay; in the present example, the audio is stored for 32 seconds altogether. Any termination of the verification process (e.g., a "disconnect command" from the CS) automatically reactivates the audio recorder 48, thus erasing the stored audio. The Interface Module stores the audio following the "alarm signal" which is sent by the alarm control panel the moment it is triggered by any detector. (See description of software for FIGS. 6A and 6B, below.)

As further shown in FIG. 2, in an embodiment of the present invention, the Interface Module 1 also comprises an integrated plug-in picture transmitter module 50. The plug-in picture transmitter module 50 comprises a video transmitter 51 and an internal cameras interface. In an embodiment of the present invention, the internal cameras interface is a camera selector 52 connected directly to remote camera units 53 or a video bus interface 54 connected directly to remote camera units 23. In an embodiment of the present invention, the video bus interface 54 is part of the Interface Module 1. Video bus 24 as referred to in an embodiment of the present invention means remote computerized camera units 25 mounted on a single cable, individually communicating with the Interface Module 1. In addition, an external remote camera interface may be integrated in the remote camera units and may comprise video storage means for a predetermined number of successive pictures of the camera (e.g., 4) (not shown).

The video storage means may also be integrated in the Interface Module 1 itself. This enables the CS operator to look at the stored or live video of each camera according to the operator's requirements. The CS operator may select the desired camera and/or the live or stored video. The video storage might also be part of the plug-in video transmitter, and thus an integral part of the Interface Module 1. The CS operator may also select picture resolution for the live video.

As shown in FIG. 2, in an embodiment of the present invention, the Interface Module 1 also comprises a modem 60 on the board enabling further features of operation, utilizing high speed communication. An example of a modem 60 application is an "audio-map" transmitted to the CS, enabling the CS operator to look at the map of the protected premises on a computer screen, where noisy remote microphone units 30 or 31 are emphasized. In an embodiment of the present invention, this "audio-map" is continuously up-dated, reflecting current noisy zones in the protected premise. In an embodiment of the present invention, the modem 60 is also used for downloading the parameters of the Interface Module 1 and of complete new software thereof.

The Interface Module according to an embodiment of the present invention may have optionally one or more of the following additional features:

a. a voltage free tamper output 67;

b. an auxiliary voltage free nc/no relay(s) output for reporting its on-line status to an external user and other applications (e.g., silencing the bells by a command from the CS);

c. "power-on", "on line", "failure" and "alarm" indicators;

d. an external unit (e.g., a computer terminal) enabling the testing and setting the audio level of the inputs of the audio channel(s) and of any other parameters; and e. additional input and output digital ports either as part of the Interface Module card 1*a* or as a plug-in card.

Other elements of the Interface Module 1, as shown in FIG. 2, include a line status sensor 61 connected to the external line 2*a* from the alarm control panel 2 and connected to the micro controller 43; a DTMF transmitter 62 connected to the micro controller 43 and the audio selecting matrix 45; an RS 232 (serial port) Interface 64; a video transmitter interface 65; a display unit 66; a loudspeaker driver 67; and a basic microphone using interface 68.

Figure 4:
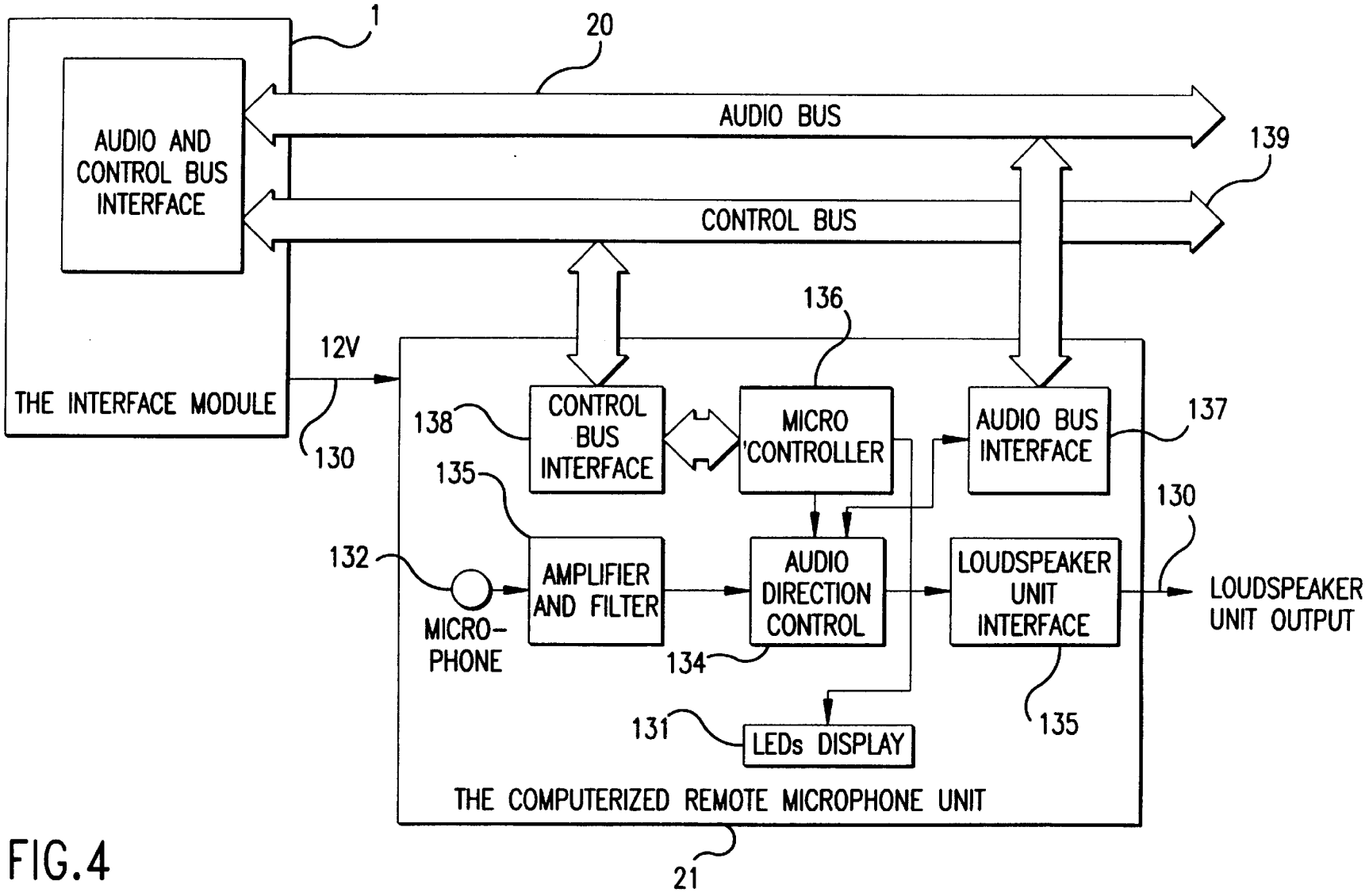
FIG. 4 shows a block diagram of a remote computerized microphone unit being connected to an audio bus.

The Interface Module 1 and the remote microphone units 21 and 30 are suitably 12 V powered (see FIG. 4). In an embodiment of the present invention, the power 70 is supplied by the alarm panel 2. However, if required, an external power supply may be added.

As shown in FIG. 2, an embodiment of the present invention consists also in a modification of the above Interface Module 1, in which the PSTN interface 12 is functionally replaced by an audio input 71 and output 72 connected to the alarm control panel 2. In this embodiment, at the end of an alarm communication, the alarm control panel 2 keeps on seizing the PSTN line 2*a* and the entire verification communication is performed via the alarm control panel 2 and its lines. For this possibility special hardware and software are required in the alarm control panel 2. If desired, both the PSTN interface 46 and the input 71 and output 72 are located on the printed circuit board of the Interface Module 1.

Figure 3:
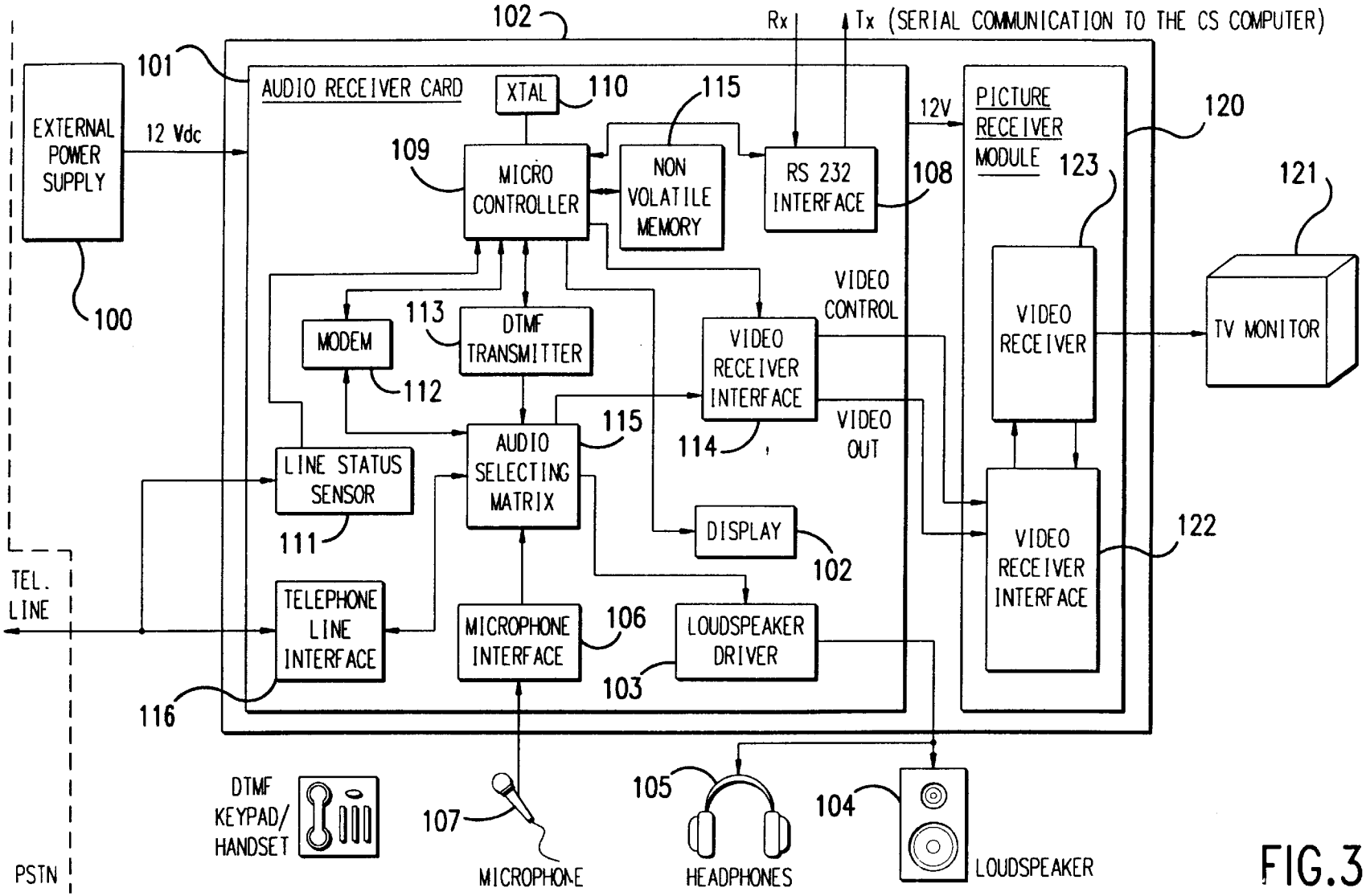
FIG. 3 shows a schematic block diagram of an audio/video receiver with optional equipment.

FIG. 3 shows a schematic block diagram of an audio/video receiver 6 with optional equipment for an embodiment of the present invention. As shown in FIG. 3, the audio/video receiver 6 is preferably 12 V powered by an external power supply unit 100. In an embodiment of the present invention, the audio/video receiver 6 is a single printed circuit board 101 located within a housing 102. In an embodiment of the present invention, each receiver 6 is located within a separate housing 102 or optionally located in a rack (see FIG. 1) containing a number (e.g., 8) audio/video receivers 6 and a power supply 100. In an embodiment of the present invention, the board 101 has visible "power-on", "on-line" and "failure" indications and a display of the account number (the code of the protected premise) 102. Moreover, the board 101 has an audio output 103 for a loudspeaker 104 (and/or headphones 105, as shown in FIG. 3) and a microphone interface unit 106 for a microphone 107. In an embodiment of the present invention, the board 101 has a serial port 108 for communication with a computer (not shown). This port 108 enables connection of several audio/video receivers 6 to a single serial port of the computer ("multidrop") (not shown in FIG. 3; see FIG. 1). In an embodiment of the present invention, the port 108 is also used for setting the parameters of the audio/video receiver 6 using a computer terminal (not shown in FIG. 3; see FIG. 1).

Other elements of the audio receiver card 101, as shown in FIG. 3, include a microcontroller 109 connected to the serial port interface 108 and connected to an Xtal unit 110, a line status sensor 111, a modem 112, a DTMF transmitter 113, the display 102, a video receiver interface 113, and a non-volatile memory unit 115; an audio selecting matrix 115 connected to the DTMF transmitter 113, the modem 112, a telephone line interface 116, the microphone interface 106, the loudspeaker driver 103, and the video receiver interface 102.

As shown in FIG. 3, for video verification a plugged-in picture receiver module 120 is required to be integrated within the audio/video receiver 6 via the audio receiver card 101 on-board video receiver interface 114. The pictures may be displayed on, for example, a TV monitor 121 or on a PC screen (not shown).

Other elements of the picture receiver module 120, as shown in FIG. 3, include a video receiver interface 122 for connection to the video receiver interface 114 of the audio and receiver card 101; the video receiver interface 122 is also connected to a video receiver 123, which is connected to the TV monitor 121.

Both the Interface Module and the audio/video receiver comply with the relevant standards of the countries in which they are used.

FIG. 4 shows a block diagram of a remote computerized microphone unit 211 (also applicable to 30, as shown in FIG. 2) connected to an audio bus 20 for an embodiment of the present invention. As shown in FIG. 4, the Interface Module 1 may comprise an internal power supply which supplies power 130 to remote microphone units 21 and/or remote camera units (not shown).

The channels between the microphone units 21 and the verification interface support the alarm industry standard cable, preferably up to a length of 200 m or even more.

As shown in FIG. 4, in an embodiment of the present invention, each remote microphone unit 21 has an optional tamper output (not shown) for protection against the opening of the housing and the removal of the unit off the wall. In an embodiment of the present invention, the remote microphone units 21 are used also for acoustic detection and have an alarm output 130. These units 21 optionally have visual display (light emitting diodes or LEDs) of the "power-on" and "on-line" (listening-in) states and an "alarm" LED (when the acoustic detection option exists) 131.

As shown in FIG. 4, Other elements of these units 21 include a microphone 132, connected to an amplifier and filter 133, in turn connected to an audio directional control unit 134, which is connected to a loudspeaker unit interface 135, connected to a loudspeaker unit output 130. Also connected to the audio direction control unit 134 is a micro controller 136, which is also connected to the LED display 131, and an audio bus interface 137. The micro controller 136 interfaces with a control bus interface 138, which interfaces with the control bus 139, in turn interfacing with the Interface Module 1. The audio bus interface 137 interfaces with the audio bus 20, which in turn also interfaces with the Interface Module 1.

The remote microphone units 80 thus are controllable by the CS operator via the Interface Module 1. The Interface Module 1 according to the present invention may be triggered by any commercially available alarm control panel (not shown in FIG. 4; see FIG. 2).

Figure 5A:
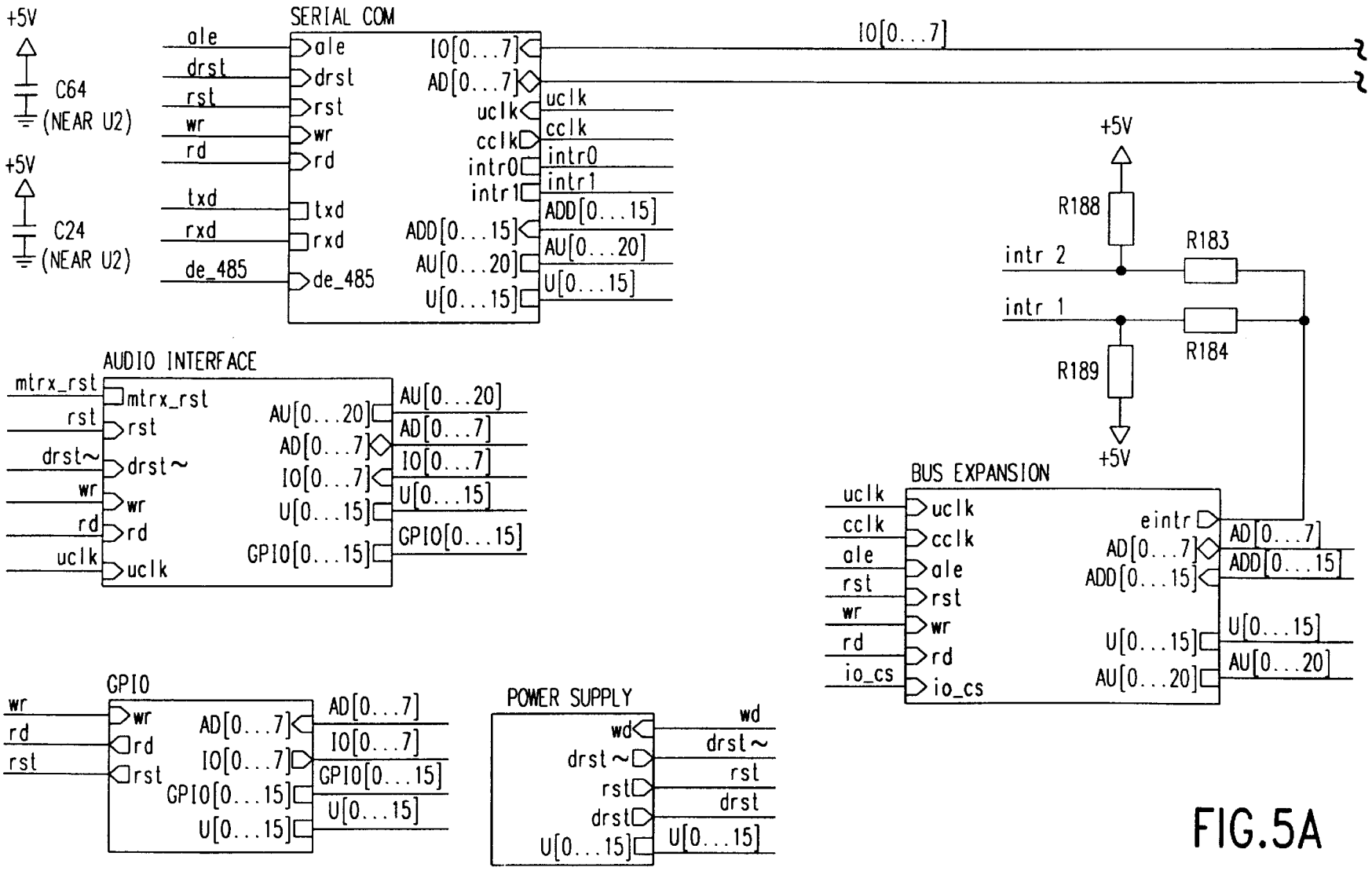
FIG. 5A and 5B shows a schematic block diagram of the Interface Module card.
Figure 5B:
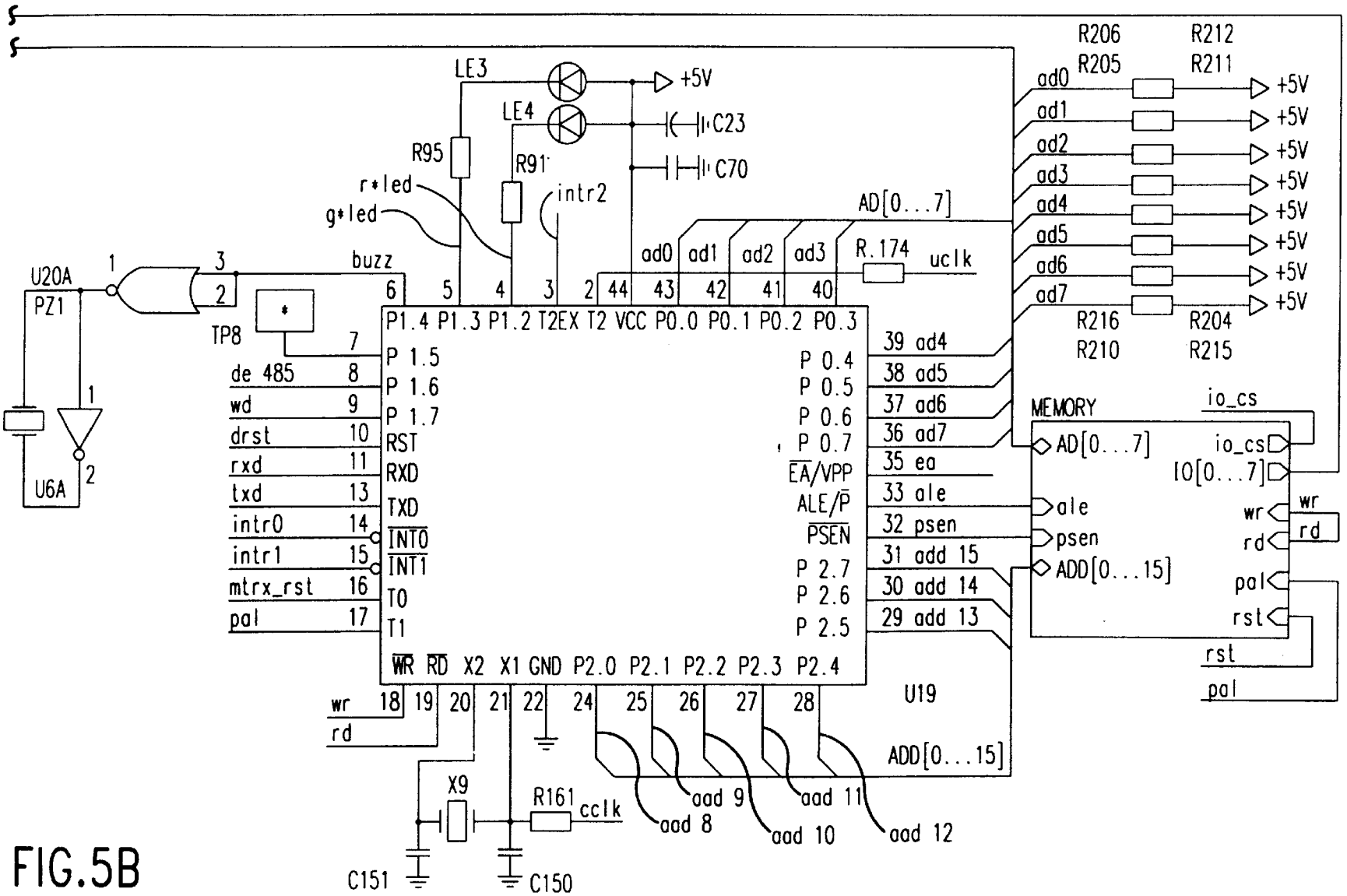

FIG. 5A and 5B shows a schematic block diagram of the Interface Module card.

The Interface Module 1 according to the present may operate in various manners, which are further described in relation to FIGS. 6A and 6B below, such as:

a. When the alarm communication has been terminated, the verification Interface Module dials to the CS—a dedicated group of telephone lines is used for the verification and the alarm receiver and its line will be ready immediately for another alarm call, the moment the alarm communication terminates; the CS equipment may consist of a DTMF handset which upon ringing will be picked up by the CS operator; the equipment may also be the audio/video receiver picking up said verification receiving line automatically and signaling the CS operator by a visual (and optionally audible) signal, being controlled by a control equipment, e.g. the desk-top control unit;

b. Using the alarm panel lines for immediate audio/video verification—the Interface Module is connected to the PSTN line of the alarm panel and seizes it at the end of the alarm communication; the PSTN line of the alarm receiver is engaged until the end of the audio/video verification, as said line is seized by the audio/video receiver; and c. When the alarm communication has been terminated, the CS operator calls the verification interface using a DTMF handset, a computer, or the above desk-top control unit.

The following optional features may be considered:

a. Talking back (two-way speech)—if a handset or a headset is used for listening-in and DTMF control, it may be used for talking to the protected premises from the CS; otherwise, a microphone will be used; the audio/video receiver has, if required, an audio input for an optional external microphone, and the Interface Module and/or the remote microphone, and the Interface Module and/or the remote microphone units have, if required, an audio output for an optional external loud speaker unit; the external loudspeaker unit may comprise also a remote microphone unit, both units together forming a two-way speech unit;

b. Call In—the Interface Module is called from the CS for the following purposes: downloading of parameters or software; testing; and listening in and looking for additional verification by the initiative of the CS operator; and c. Callback—dialing to the telephone line to which the verification interface is connected and ringing a preset number of rings causes the module to dial-back to the audio/video receiver.

Figure 6A:
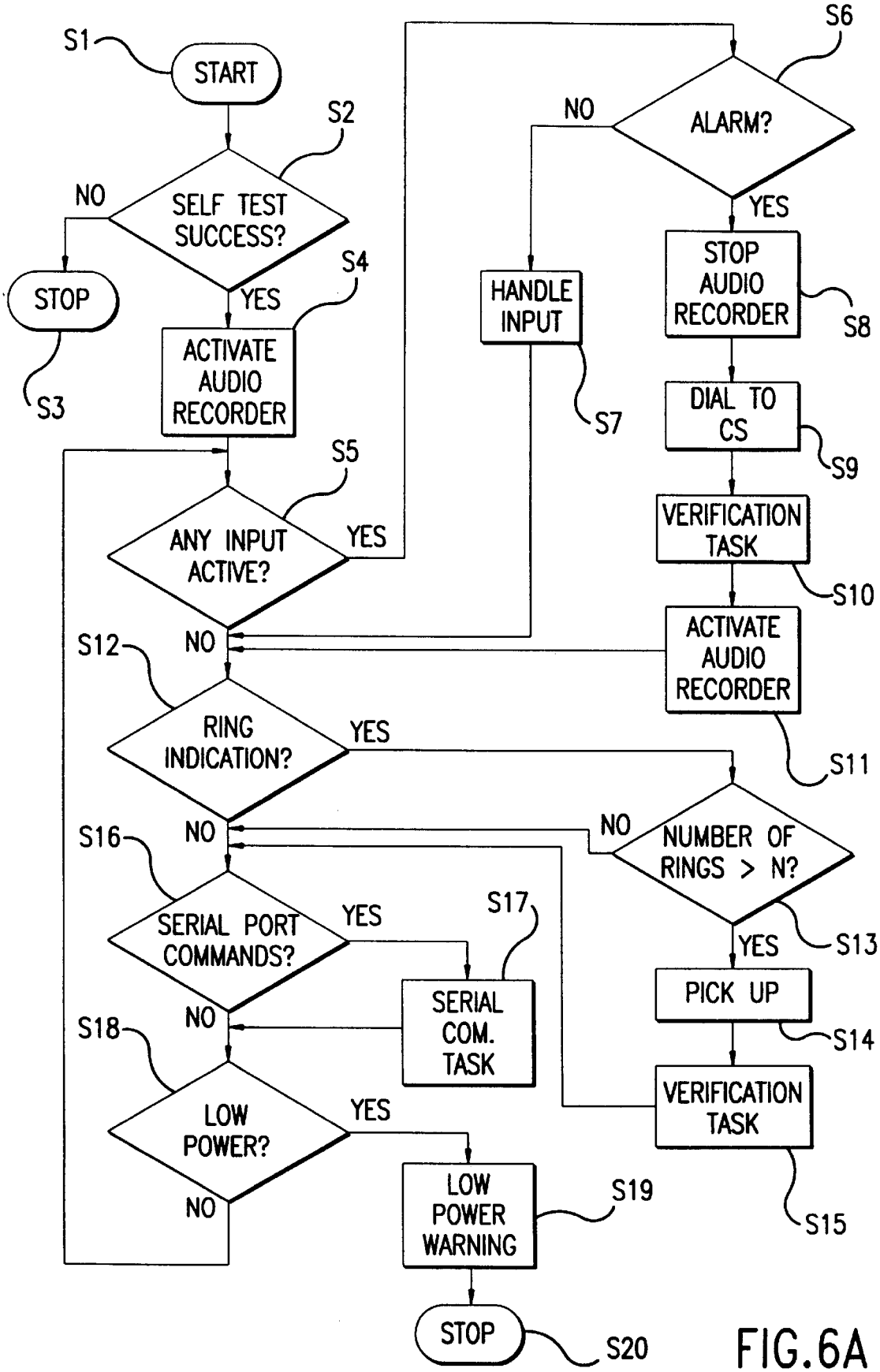
FIGS. 6A and 6B show the flowchart of the software of the Interface Module.
Figure 6B:
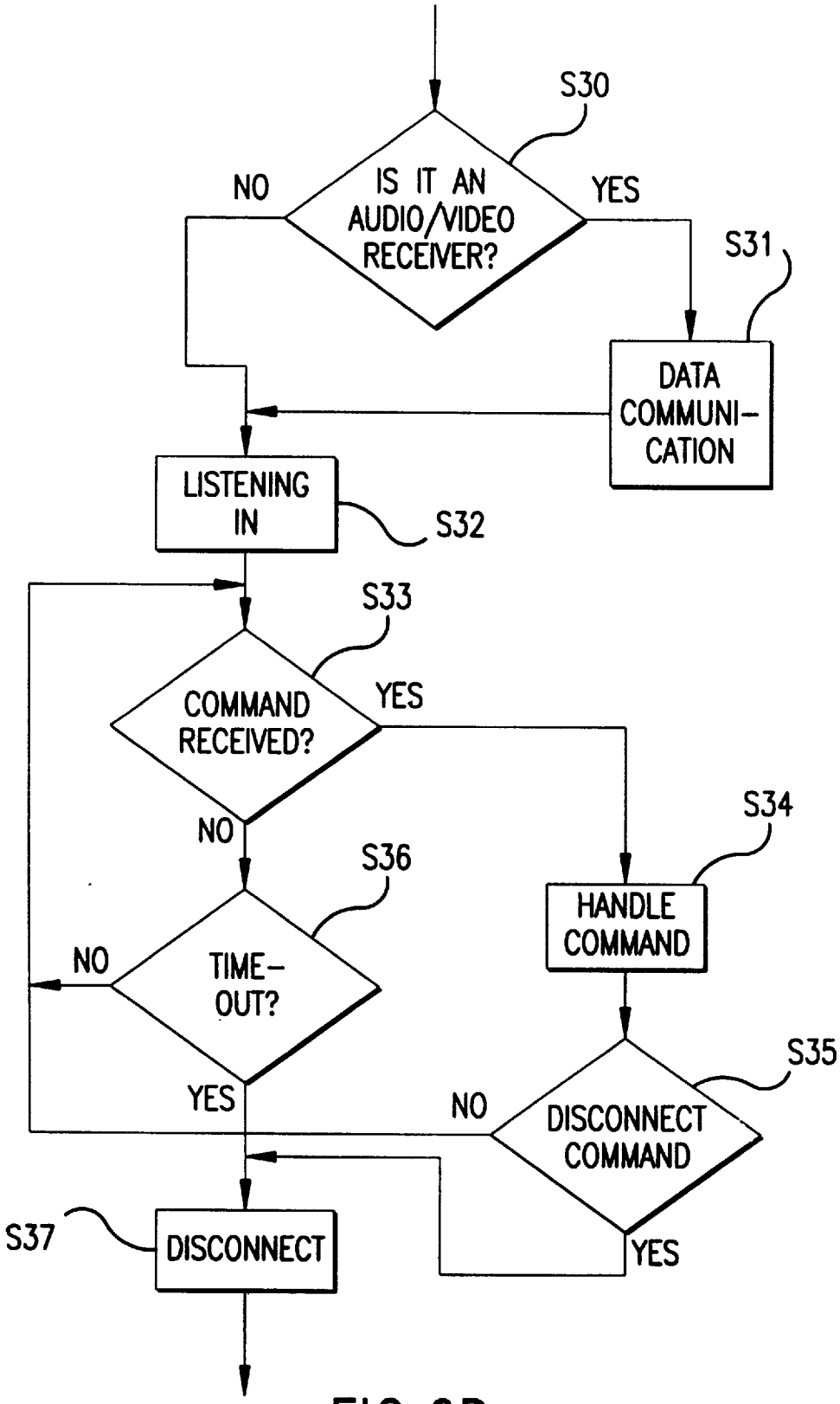

FIGS. 6A and 6B show the flowchart of the software of the Interface Module. FIG. 6A presents the overall Interface Module Software Flowchart. FIG. 6B contains the Verification Task of the Software.

In FIG. 6A, step S1 is the start of the Interface Module software. In step S2, a determination is made as to whether the self test was a success. If no, the software proceeds to step S3, stop. If yes, the software proceeds to step S4, Activate Audio Recorder.

The software then proceeds to step S5 to determine whether any input is active. If no, the software proceeds to step S11, below. If the software determines that there is an active input in step S5, the software proceeds to step S6 to determine whether the input is the alarm. If no, the software proceeds to step S7 to handle the input. The system then proceeds to step S11, below.

If the software determines in step S6 that the input is the alarm, the software proceeds to step S8 to stop the audio recorder. The software then dials the CS in step S9. In step S10, the verification task is performed, as detailed with regard to FIG. 6B below. Following the verification task of step S10, the software proceeds to step S11 to activate the audio recorder.

In step S12, the software determines whether there is a ring indication. If no, the software proceeds to step S16, below. If yes in step S12, the software proceeds to step S13, in which it determines whether the number of rings exceeds a set number, N. If no, the software proceeds to step S16, below. If yes in step S13, the software picks up in step S14. In step S15, the software performs the verification task, described below in relation to FIG. 6B. The software then proceeds to step S16.

In step S16, the software determines whether there are serial port commands to be performed. If no, the software proceeds to step S18, below. If yes in step S16, the software proceeds to step S17 to perform serial port command tasks.

In step S18, the software determines whether there is low power. If no, the software returns to step S5, above. If yes in step S18, the software proceeds to step S19 to provide a low power warning. In step S20, the software stops.

FIG. 6B presents the verification task flowchart. The verification task begins with step S30, in which the software determines whether the input is an audio/video receiver. If no, the software proceeds to step S32, below. If yes in step S30, the software proceeds to step S31 to begin data communication.

In step S32, the software listens to the communication.

In step S33, the software determines whether a command was received. If no, the software proceeds to step S36. In step S36, the software determines whether to timeout. If no, the software returns to step S33, above.

If yes in step S33, the software proceeds to step S34 to handle the command. In step S35, the software determines whether a disconnect command is received. If no, the software returns to step S33, above. If a disconnect command is received in step S35, the software proceeds to step S37, disconnecting. This completes the verification task.

I claim:

1. A device to be connected to any standard alarm control panel for the verification of an actuated alarm, said device comprising at least one printed circuit board which is located within a housing of integrated within the alarm control panel, on which board are located an alarm panel interface receiving the alarm signal from the alarm control panel, a specially programmed microcontroller, a non volatile memory, an audio selecting matrix being connected to at least one remote microphone unit and a public switch telephone network (PSTN) interface which is connected to a telephone line through which the interface module communicates with the control station, the device comprising an integrated plug-in picture transmitter module, which module comprises a video transmitter and an internal cameras interface, the video transmitter being connected to a video transmitter interface being part of the interface module wherein an external remote camera interface is integrated in the remote camera units, and comprises picture storage means.

2. A device according to claim 1, wherein said internal cameras interface is a camera selector being connected directly to the remote camera units.

3. A device according to claim 1, wherein said internal cameras interface is a video bus interface being connected via a video bus to remote computerised camera units.

4. A device according to claim 1, comprising a voltage free tamper output.

5. A device according to claim 1, comprising "power-on", "on-line", "failure" and "alarm" indicators.

6. A device to be connected to any standard alarm control panel for the verification of an actuated alarm, said device comprising at least one printed circuit board which is located within a housing or integrated within the alarm control panel, on which board are located an alarm panel interface receiving the alarm signal from the alarm control panel, a specially programmed microcontroller, a non volatile memory, an audio selecting matrix being connected to at least one remote microphone unit and a public switch telephone network (PSTN) interface which is connected to a telephone line through which the interface module communicates with the control station, the device comprising a modem on the board.

7. A device to be connected to any standard alarm control panel for the verification of an actuated alarm, said device comprising at least one printed circuit board which is located within a housing or integrated within the alarm control panel, on which board are located an alarm panel interface receiving the alarm signal from the alarm control panel, a specially programmed microcontroller, a non volatile memory, an audio selecting matrix being connected to at least one remote microphone unit and a Public switch telephone network (PSTN) interface which is connected to a telephone line through which the interface module communicates with the control station, the device comprising an auxiliary voltage free nc/no relay(s) output.

8. A device to be connected to any standard alarm control panel for the verification of an actuated alarm, said device comprising at least one printed circuit board which is located within a housing or integrated within the alarm control panel, on which board are located an alarm panel interface receiving the alarm signal from the alarm control panel, a specially programmed microcontroller, a non volatile memory, an audio selecting matrix being connected to at least one remote microphone unit and a public switch telephone network (PSTN) interface which is connected to a telephone line through which the interface module communicates with the control station, the device comprising an external unit enabling the testing and setting of parameters including audio level.

9. A device according to claim 8, wherein the PSTN interface is a DTMF handset.

10. A device to be connected to any standard alarm control panel for the verification of an actuated alarm, said device comprising at least one printed circuit board which is located within a housing or integrated within the alarm control panel, on which board are located an alarm panel interface receiving the alarm signal from the alarm control panel, a specially programmed microcontroller, a non volatile memory an audio selecting matrix being connected to at least one remote microphone unit and a public switch telephone network (PSTN) interface which is connected to a telephone line through which the interface module communicates with the control station, the device being connected to a CS comprising one or more of the following pieces of equipment:

a. a PSTN line interface, b. listening-in equipment, selected among a handset, and audio amplifier with loudspeaker and/or headphones, c. remote control facilities, selected among a DTMF keypad, and a computer, d. picture receivers and TV monitors, and e. talking back facilities, selected among a handset and a microphone.

11. A device according to claim 10, wherein the PSTN interface is an audio/video receiver (as herein defined) that is identical with the interface module but controlled by different software.

12. A device to be connected to any standard alarm control panel for the verification of an actuated alarm, said device comprising at least one printed circuit board that is located within a housing or integrated within the alarm control panel, on which board are located an alarm panel interface receiving the alarm signal from the alarm control panel, a specially programmed microcontroller, a non volatile memory, an audio selecting matrix being connected to at least one remote microphone unit and a public switch telephone network (PSTN) interface that is connected to a telephone line through which the interface module communicates with the control station and wherein the device comprises a modem on the board.

13. A device according to claim 12, wherein the remote microphone units are remote microphone units that include a microprocessor, the remote microphone units being connected via an audio bus and a bus interface to said audio selecting matrix.

14. A device according to claim 13, which comprises an audio storage unit comprising an audio recorder which is connected to the audio selecting matrix.

15. A modification of the interface module according to claim 12, in which the PSTN interface is functionally replaced by an audio input and output being connected to the alarm control panel.

16. An interface module according to claim 15, wherein both the PSTN interface and the audio input and output are located on the printed circuit board.

17. A device to be connected to any standard alarm control panel for the verification of an actuated alarm, said device comprising at least one printed circuit board that is located within a housing or integrated within the alarm control panel, on which board are located an alarm panel interface receiving the alarm signal from the alarm control panel, a specially programmed microcontroller, a non volatile memory, an audio selecting matrix being connected to at least one remote microphone unit and a public switch telephone network (PSTN) interface that is connected to a telephone line through which the interface module communicates with the control station and wherein the device comprises "power-on", "on-line", "failure" and "alarm" indicators.

* * * * *